United States Patent [19]

Berg

[11] Patent Number: 4,787,163

[45] **Date of Patent: * Nov. 29, 1988**

[54] VEHICLE MOUNTED SIGN

[76] Inventor: Marlin C. Berg, 5851 Farmington Rd., West Bloomfield, Mich. 48033

[ * ] Notice: The portion of the term of this patent subsequent to Jun. 9, 2004 has been disclaimed.

[21] Appl. No.: 27,392

[22] Filed: Mar. 18, 1987

Related U.S. Application Data

[63] Continuation-in-part of Ser. No. 874,877, Jun. 16, 1986, Pat. No. 4,671,004, which is a continuation-in-part of Ser. No. 723,917, Apr. 16, 1985, abandoned.

[51] Int. Cl.[4] ..... G09F 21/04

[52] U.S. Cl. ..... 40/592; 40/464

[58] Field of Search ..... 40/584, 591, 592, 564, 40/10

[56] References Cited

U.S. PATENT DOCUMENTS

| | | | |
|---|---|---|---|
| D. 204,727 | 5/1966 | Diehl | 40/592 X |
| 1,752,591 | 4/1930 | Ellis | 40/592 |
| 2,077,585 | 4/1937 | Rivers | 40/592 |
| 2,960,786 | 11/1960 | Wagner | 40/592 |
| 3,153,294 | 10/1964 | Hay et al. | 40/592 |
| 3,208,173 | 9/1965 | Shank | 40/592 |
| 4,667,428 | 5/1987 | Elmer | 40/592 |
| 4,671,004 | 6/1987 | Berg | 40/592 |
| 4,688,343 | 8/1987 | Allan | 40/592 |

*Primary Examiner*—Gene Mancene
*Assistant Examiner*—Wenceslao J. Contreras
*Attorney, Agent, or Firm*—Krass & Young

[57] ABSTRACT

A portable sign for removable mounting on the roof of a vehicle. The sign includes a rigid body formed of first, second and third side walls formed into a rigid triangular structure, a top structure including a triangular top wall and a frame fitting over the top wall and including a downturned flange extending around the laterally outer triangular perimeter of the top wall, and a bottom structure including a triangular bottom wall and a bottom frame including an upturned flange extending totally around the laterally outer perimeter of the bottom wall. The upper edge portion of the triangular body structure is positioned contiguously within and attached to the downturned flange of the top structure and the lower edge portion of the triangular body structure is positioned contiguously within and attached to the upturned flange of the bottom structure. An alarm assembly is also provided within the rigid body. The alarm assembly includes a first alarm circuit operative to sound an alarm in response to tilting movement of the sign out of a predetermined, prescribed angular position relative to the roof of the vehicle and a second alarm circuit operative to sound an alarm in response to disconnection of an electrical power supply to the sign.

6 Claims, 3 Drawing Sheets

VEHICLE MOUNTED SIGN

RELATED APPLICATION

This application is a continuation-in-part of application Ser. No. 874,877 filed June 16, 1986 now U.S. Pat. No. 4,671,004 and which is a continuation in part of Serial No. 723,917, filed Apr. 16, 1985 and entitled "Vehicle Mounted Portable Sign", which is now abandoned.

FIELD OF THE INVENTION

This invention relates, in general, to signs and, more specifically, to portable signs for mounting on vehicles.

DESCRIPTION OF THE PRIOR ART

Signs have long been mounted on the sides or roofs of vehicles for various advertising or identification purposes. A roof mounted sign is especially popular due to its ease of visibility from all sides of the vehicle so as to effectively advertise the purpose of the vehicle or identify the product currently being transported or delivered by the vehicle.

Such signs have been fabricated from various materials such as metal, plastic, paper, etc. Typically, these vehicle mounted signs are formed of a body which is removably mounted on the roof of the vehicle to which various advertising or other printed matter is attached or imprinted. Such signs include a frame to which various panels are mounted. The frame is typically formed of a metallic material such as steel, etc. while the frame members may be formed of plastic, paper or the like.

The sign body itself is typically removably mounted on the roof via straps, guy lines or suction cups or a combination thereof so as to enable the sign to be removably mounted on the vehicle.

Typically, due to the printed matter employed with such signs, they are not visible at night or in other periods of limited visibility.

It is known to employ illuminated signs on vehicles such as taxis, etc. to indicate the name of the taxi company or whether the taxi is in use. However, such signs are not removably mounted on the vehicle but rather are made a permanent part of the vehicle. Illuminated signs have also been employed for various other vehicle rooftop purposes. However, such illuminated signs have not enjoyed wide popularity since the illumination provided has not been sufficient to make the printed matter on the sign more visible or to attract attention to the sign.

Vehicle mounted signs are also prone to unauthorized removal from the vehicle due to their readily detachable securement to the top of the vehicle. These signs are also subject to movement or lifting during operation of the vehicle as a result of wind pressure.

SUMMARY OF THE INVENTION

This invention is directed to the provision of an improved vehicle mounted sign.

More particularly, this invention is directed to the provision of a vehicle mounted sign which is simple and inexpensive in construction and which provides maximum visual impact with respect to the advertising material carried thereon. This invention is also directed to the provision of a vehicle mounted sign which includes sensor or alarm means for indicating movement of the sign during use of the vehicle or authorized removal of the sign from the vehicle.

The sign of the invention includes an upper substantially planar frame structure having a triangle configuration; a lower substantially planar frame structure having a triangle configuration matching that of the upper frame structure; and a side panel assembly of hollow triangular configuration matching the triangle configuration of the upper and lower frame structures. The side panel assembly defines first, second and third panel sides with at least two of the sides formed integrally from a continuous rigid panel bent to form a rigid apex of the assembly triangle and provide a rigid triangular panel structure, and the panel assembly extends vertically between the upper and lower frame structure to form the sole interconnection between the frame structure and form a structural member solely supporting the upper frame structure with respect to the lower frame structure. The sign further includes means securing the upper and lower triangular edge portions of the side panel assembly respectively to the laterally outer triangular perimeters of the upper and lower frame structure with the outer display face of each panel side lying substantially in the plane of the associated laterally outer side edges of the frame structure to form a continuous uninterrupted closed loop viewing display surface extending 360° with respect to the central vertical axis of the sign, extending for substantially the full height of the panel sides and presenting at the outer lateral triangle extents of the sign.

According to a further feature of the invention, the sign includes an alarm device positioned on the sign body and sensing means operative in response to movement of the sign body from its predetermined prescribed position relative to the vehicle roof to actuate the alarm. This arrangement generates an alarm signal in the event that unauthorized removal of the sign is attempted.

According to one aspect of the invention, the sensing means senses removal of the sign from the vehicle roof, and in another aspect of the invention, the sensing means senses a change in an angle of the sign relative to the vehicle roof.

According to a further feature of the invention, the sign further includes an electrical power cord connected to the sign and connectable to a source of vehicle power and the sensing means includes means operative in response to disconnection of the power cord from the sign to actuate the alarm. This arrangement ensures that the alarm will be actuated in the event of unauthorized removal of the sign from the vehicle since the power cord connected to the vehicle must be disconnected in the course of removing the sign from the vehicle.

According to a further feature of the invention, the sign further includes an electric alarm circuit including the alarm device, a first switch connected to the power cord and operative in response to power from the power cord to maintain a first open condition in the alarm circuit, and a second arming switch having a disarmed position in which it maintains a further open condition in the alarm circuit and an armed position in which it completes the alarm circuit therethrough. With this arrangement, disconnection of the power cord from the sign with the arming switch in its disarmed position will not generate an alarm whereas disconnection of the power cord from the sign with the arming switch in its armed position will activate the alarm. The vehicle operator may thereby ensure that the alarm will be activated in response to unauthorized removal by arming the arming switch prior to leaving the vehicle unattended.

According to a further feature of the invention, the arming switch includes a removable member operative when present to maintain the further open condition of the alarm circuit and operative when removed to complete the alarm circuit through the arming switch and thereby arm the alarm circuit. This arrangement allows the vehicle operator to readily remove the arming member upon leaving the vehicle to thereby arm the sign.

According to a further feature of the invention, the removable member includes a pin portion insertable into a socket in the sign to move the arming switch to its disarmed position and disarm the alarm circuit and a handle portion connected to the pin portion and positioned exteriorally of the sign body with the pin portion received in the sign socket. This arrangement allows the handle portion to be readily grasped by the vehicle operator to facilitate removal of the pin portion from the sign socket to thereby move the arming switch to its armed position and arm the alarm circuit.

According to another aspect of the invention, the arming switch comprises a receiver device positioned on the sign and movable in response to signals from a transmitter device between its armed and disarmed positions. This arrangement eliminates the need to remove a member from the sign to arm the sign but rather allows the sign to be armed and disarmed by signals from a remote transmitter device.

According to a further feature of the invention, the sign body is hollow to define an interior chamber and includes non-opaque panels; the sign further includes light means positioned within the chamber; the alarm circuit is positioned within the chamber and further includes a battery positioned within the chamber; the power cord extends into the chamber for connection to the first switch; the first switch is a relay switch operative to establish the first open condition in the alarm circuit in response to power from the power cord and operative to complete the alarm circuit therethrough in response to interruption of power from the power cord; and the light means are in a separate illumination circuit positioned within the chamber and connected directly to and powered by the power cord. With this arrangement, with the arming switch in its disarmed position, the sign may be attached to the roof of the vehicle and the power cord connected thereto to power the lights without actuating the alarm, but when the vehicle operator thereafter leaves the vehicle, he may arm the arming switch so that any attempt in his absence to remove the sign from the vehicle will disconnect the power cord and interrupt power to the relay switch to actuate the alarm device.

According to a further aspect of the invention, the sensing means includes a battery powered alarm circuit positioned in the chamber and including an angle sensitive switch. In the disclosed embodiment of the invention, the angle sensitive switch comprises a mercury switch positioned in the battery circuit. This arrangement allows the sensing means to sense a change in a predetermined prescribed angle of the sign relative to the vehicle rooftop and thereby actuate an alarm signal.

DETAILED DESCRIPTION OF THE PREFERRED EMBODIMENT

Figure 1:
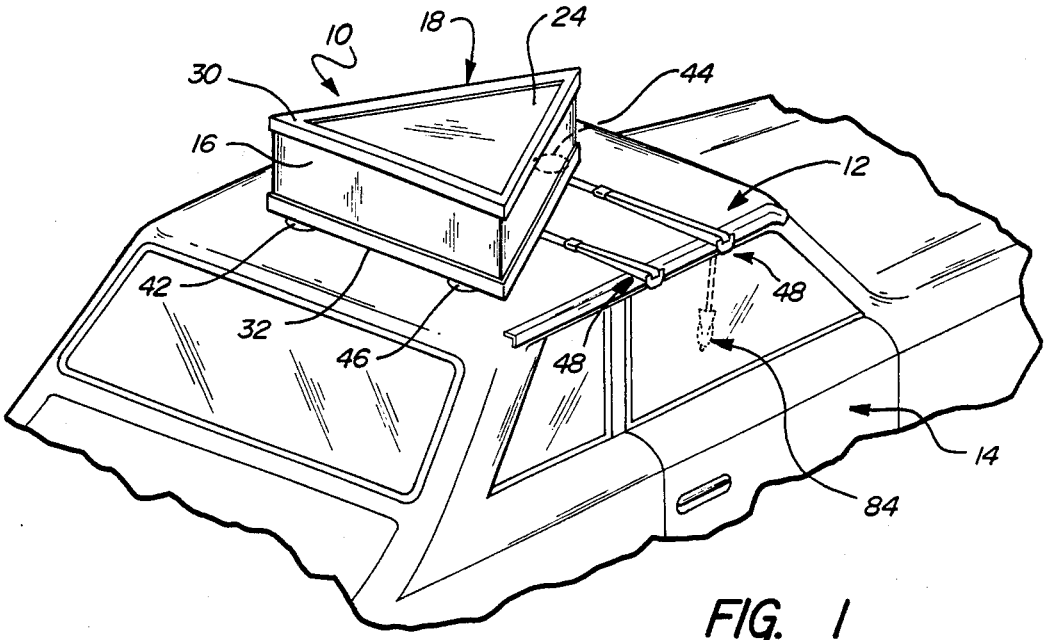
FIG. 1 is a perspective view of a vehicle having a portable sign mounted thereon constructed in accordance with the teachings of the present invention.

The invention portable sign 10 is intended to be removably mounted upon the roof 12 of a vehicle 14 such as an automobile and is configured for carrying various printed indicia directly thereon.

Sign 10 includes a hollow body 11 comprised of first, second and third side walls 16, 18 and 20. Side walls 18 and 20 are integrally formed from a single piece strip of a suitable plastic material bent to provide a rigid V configuration. Side wall 16 is formed as a separate, planar rigid panel. The plastic material may be any transparent, semitransparent, or opaque plastic material which carries various printed indicia, not shown, for advertising or display purposes. The indicia can be applied to the side walls 16, 18 and 20 in any suitable manner such as by silk screening. Side walls 16, 18 and 20 include one integral edge 21*a* formed at the bend between side walls 18 and 20 and two overlapped abutting edges 21*b* and 21*c* formed at the respective interfaces between panels 18 and 20 and separate panel 16.

Sign 10 further includes an external frame 22 and triangular top and bottom wall panels 24 and 26. External frame 22 includes upper and lower triangular frame members 30 and 32. External frame 22 attaches top and bottom walls 24 and 26, respectively, to the upper and lower edges of the side walls 16, 18 and 20 to form a closed, hollow interior within the sign body 12. Frame members 30 and 32 are preferably formed of a plastic material to provide a lightweight, weatherproof assembly.

Figure 3:
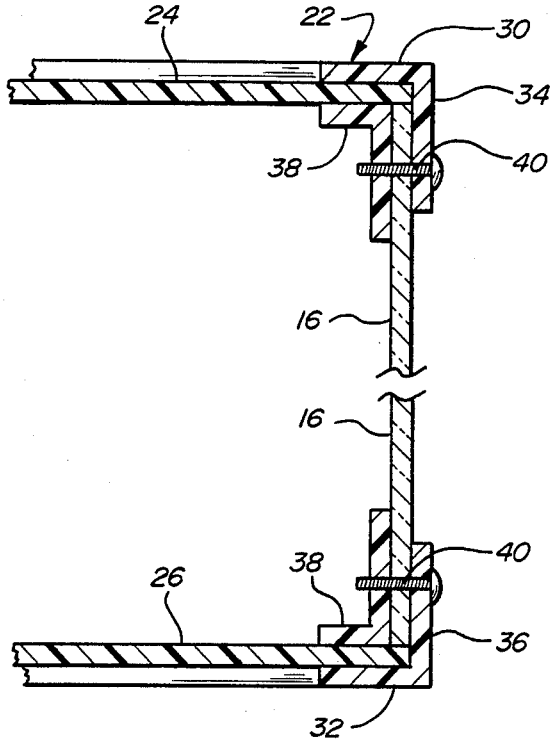
FIG. 3 is a cross-sectional view generally taken along line 3—3 in FIG. 2.

Upper and lower frame members 30 and 32 have an L-shaped cross section. The outer legs 34 and 36, respectively, of the frame members 30 and 32 are disposed in proximity with one of the side walls 16, 18 and 20 of the sign body 11. L-shaped flange members 38, shown in FIG. 3, are mounted, such as by the use of adhesive, on the upper and lower surfaces of top and bottom walls 24 and 26, respectively, at circumferentially spaced intervals about the perimeter of the top and bottom walls and in spaced relation to the inner circumferences of legs 34 and 36 to define respective upper and lower grooves therebetween for receipt of the upper and lower edge portions of side walls 16, 18 and 20. Fasteners 40 extend through apertures formed in the legs 34 and 36, the edge portions of the side walls 16, 18 and 20, and the flange members 38 for joining the frame 22, the side walls 16, 18 and 20, and the top and bottom walls 24 and 26 into an integral, rigid solid, closed structure.

Means are also provided for securely and detachably mounting the sign on the roof 12 of the vehicle 14. The mounting means include a plurality of suction cups 42, 44 and 46 and strap members 48.

Suctions cups 42, 44, and 46 are conventional in construction and are secured by means of fasteners to the bottom wall 26 of the sign. The suction cups 42, 44, and 46 enable the sign to be mounted on the roof 12 of the vehicle by appropriately positioning the sign in the desired location on the roof 12 and applying downward pressure to thereby create a suction within the suction cups 42, 44 and 46 to detachably but yet securely mount the sign on the roof 12 of the vehicle 14.

Figure 2:
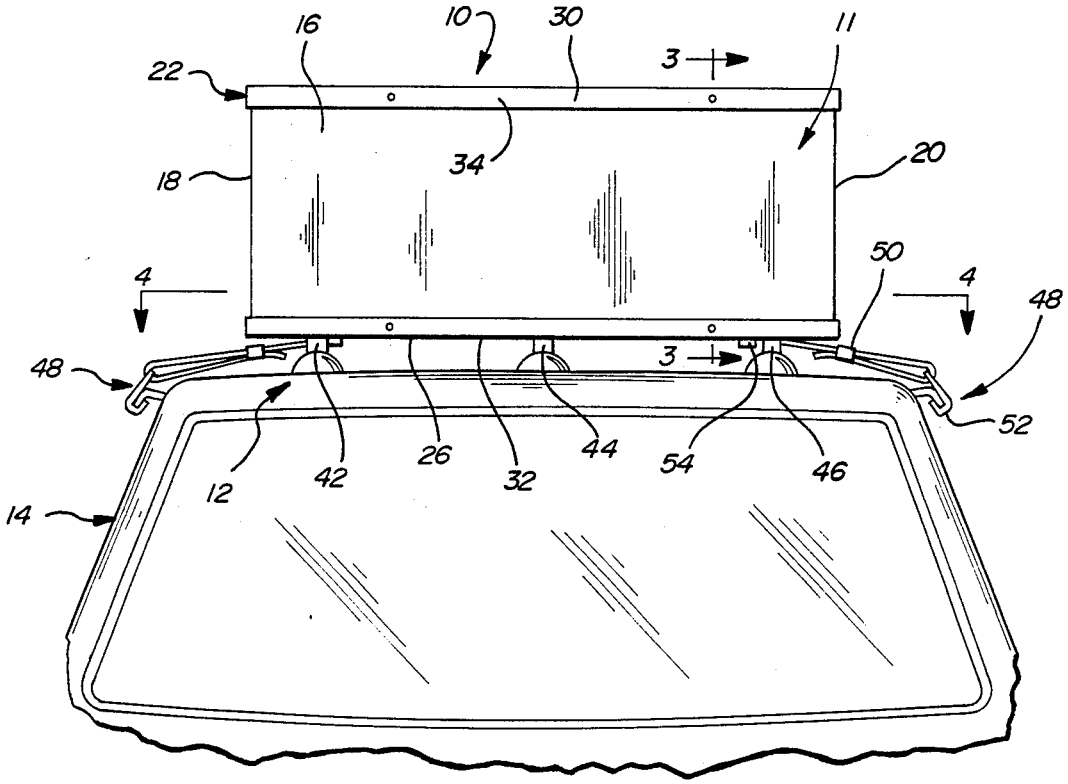
FIG. 2 is a rear view of the sign and vehicle shown in FIG. 1.

Strap members 48 are preferably provided in opposed pairs attached to the bottom wall 26 of the sign, preferably in proximity to the opposed side walls 18 and 20. Each of the strap members 48 comprises elongated strap 50 and a substantially L-shaped hook or clamp member 52. Each of the hook members 52 has an aperture therein which receives one end of the associated strap member 50. The opposite end of each strap member 50 is secured to the bottom wall 26 of the sign by a suitable fastener 54 as shown in FIG. 2.

The opposite end of each strap member 50 is provided with a clasp which enables a loop to be formed on each strap member 50 after it has been inserted through the aperture in the clamp member 52 and secured in a tightened manner to securely mount the sign on the roof 12 of the vehicle 14 in cooperation with the suction cups 42, 44, and 46.

Figure 4:
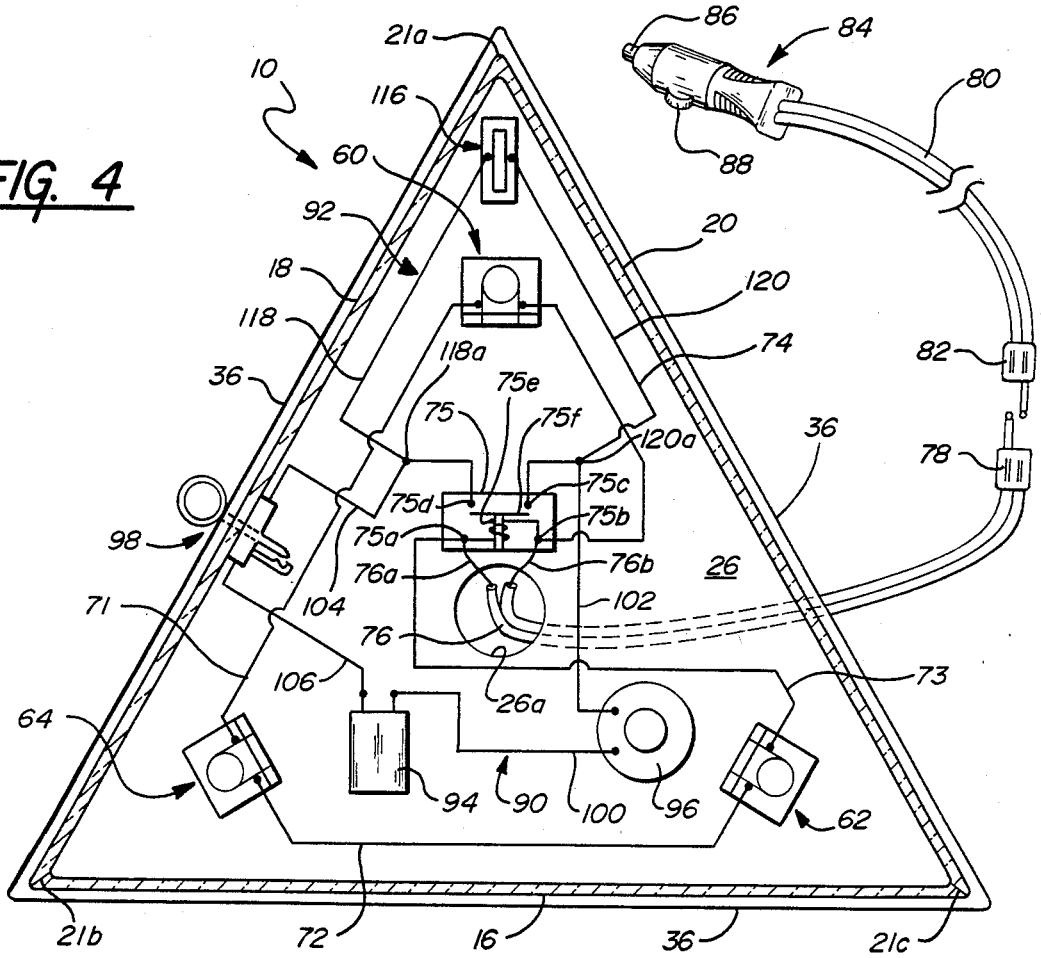
FIG. 4 is a cross-sectional view taken along line 4—4 of FIG. 2.
Figure 5:
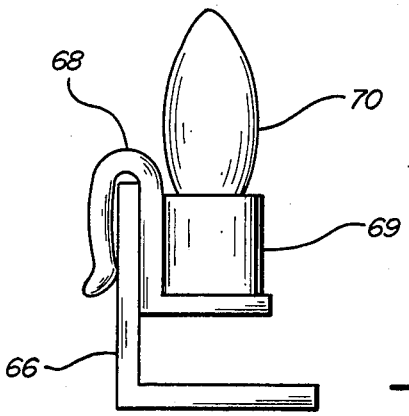
FIG. 5 is a fragmentary view showing a light for use in the invention sign.

The sign also includes illumination means for illuminating the interior of the body 11 and thereby illuminate the printed indicia on the side walls 16, 18, and 20. As shown in FIGS. 4 and 5, the illumination means comprise at least one and preferably a plurality of light assemblies 60, 62, and 64. Assemblies 60, 62, and 64 are positioned on bottom wall 26 at the three corners of the sign to provide interior illumination for the sign.

Each light assembly includes an L-shaped bracket 66 secured to the upper surface of bottom wall 26, a clip 68 resiliently engaging the upstanding leg of bracket 66 and supporting a light socket 69, and a lightbulb 70 positioned in the light socket. An electrical wire 71 extends between light assembly 64 and light assembly 60; a further wire 72 extends between light assembly 64 and light assembly 62; and further wires 73 and 74 extend respectively from light assemblies 62 and 60 to opposite terminals **75*a* and 75*b* of a relay switch 75 positioned centrally on the upper surface of bottom wall 26. An elongated electrical cord 76 has its two wires 76*a* and 76*b* respectively connected to the terminals 75*a* and 75*b* of relay switch 75. Cord 76 passes through a central opening 26*a* in bottom wall 26 to the exterior of the sign and terminates in a connector member 78. A further cord 80 includes a connector member 82 at one end for coupling coaction with connector member 78 in known manner and includes a plug assembly 84 at its other end. Plug assembly 84 includes an outwardly extending projection 86 as well as a grounding contact 88 provided on the body of the plug assembly. Plug assembly 84 is designed to be removably received within the conventional cigarette lighter mounted within the vehicle 14 to thereby connect the illumination means of the sign to the battery of the vehicle in order to provide power to the light assemblies 60, 62, and 64. Alternatively, plug assembly 84 may be designed to be removably connectable directly to the battery of the vehicle or to any other convenient electrical connection point such as the vehicle tailights. In configurations where the connector 84 is connected to the vehicle battery or to the vehicle tailights, a toggle switch may be mounted on the bottom surface of bottom wall 26** and connected in series with the electrical circuit to the battery of the vehicle to enable selective energization of the illumination means.

The invention sign also includes a first alarm circuit 90 for sensing the unauthorized removal of the sign from the roof of the vehicle and a second alarm circuit 92 for sensing tilting movement of the sign out of its predetermined prescribed position relative to the vehicle roof.

Alarm circuit 90 includes a battery 94; an alarm device 96; relay switch 75; and an arming switch 98. Battery 94 is connected to alarm device 96 by wire 100; alarm device 96 is connected to terminal **75*c* of relay 75 by wire 102; arming switch 98 is connected to terminal 75*d* of relay 75 by wire 104; and arming switch 98 is connected to battery 94 by wire 106**.

Battery 94 may take any of several well-known forms and may, for example, comprise a readily available 9-volt battery.

Alarm device 96 may also take various forms and preferably comprises an audible alarm operative to emit a shrieking or otherwise obnoxious noise in response to activation. Alarm device 96 may comprise, for example, an alarm device available from KSP America Corporation of San Francisco, Calif. under the designation Siren SSP-2, 6-12 VDC. Relay switch 75 is of known form and operates in known manner in response to passage of current through the relay coil **75*e* to pull switch 75*f* away from relay contact 75*c*, 75*d*. In the absence of current through coil 75*e*, swith 75*f* is spring urged to a position closing terminals 75*c* and 75*d* to complete a circuit between wires 102 and 104**.

Figure 6:
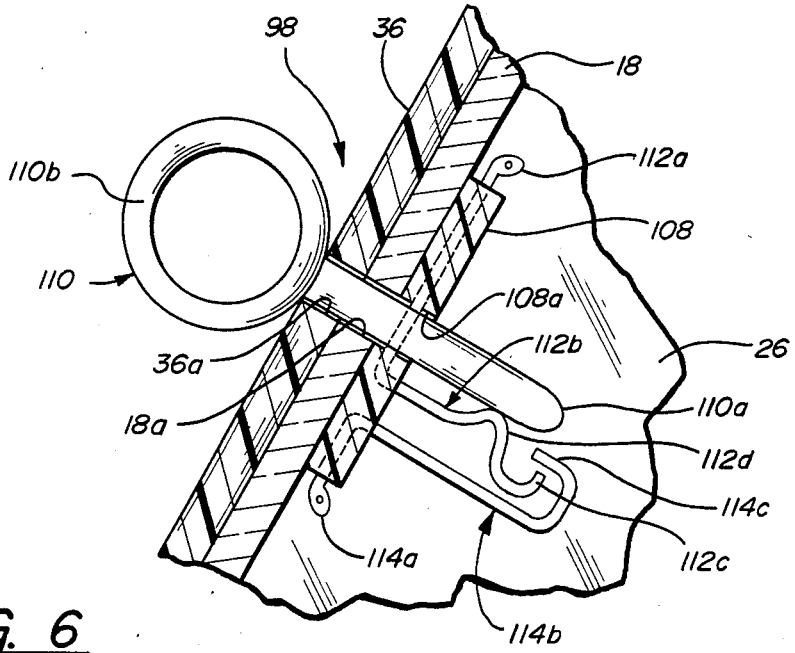
FIG. 6 is a fragmentary view of an arming switch used in the invention sign.

Arming device 98, as best seen in FIG. 6, includes a base member 108 adapted to be suitably secured to the inner periphery of side panel 18 adjacent bottom panel 26 and an arming member 110.

Base member 108 is formed of a suitable dielectric material and includes first and second spring steel contact members 112 and 114 embedded in the dielectric body of member 108. Contact member 112 extends from a terminal **112*a*, for connection to wire 104, to an upstanding contact portion 112*b*. Contact member 114 extends from a terminal 114*a*, for connection to wire 106, to an upstanding contact portion 114*b***.

Arming member 110 includes a pin portion **110*a* extending through a socket defined by aligned apertures 36*a*, 18*a*, and 108*a*, formed respectively in members 36, 18, and 108, for coaction at its inner end with contacts 112, 114. Arming device 110 further includes a ring-shaped handle portion 110*b* secured to pin portion 110*a* and positioned exteriorally of the sign with the pin portion positioned within the socket defined by aligned apertures 36*a*, 18*a*, and 108*a*. With arming member in its inserted position, a tip end 112*c* of contact 112 is maintained in spaced position relative to the tip 114*c* of contact 114 by the engagement of pin portion 110*a* with cam portion 112*d* of contact 112. When the arming device is removed, tip portion 112*c* of contact 112 moves into contact with the tip portion 114*c* of contact 114 by the natural spring resilience of contact 112**.

Alarm circuit 92 includes a mercury switch 116 of known form positioned on bottom panel 26 within the apex formed by side panels 18 and 20; a wire 118 connecting mercury switch 116 to wire 104 at **118*a*; and a wire 120 connecting mercury switch 116 to wire 102** at 120*a*. It will be seen that mercury switch 116 and wires 118 and 120 coact with wires 104, 106, 100, and 102 to form an alarm circuit including mercury switch 116, arming device 98, battery 94, and alarm device 96. It will further be seen that arming device 98 controls the arming and disarming of both alarm circuit 90 and alarm circuit 92, and alarm circuit 90 is further conditioned by relay 75.

The invention sign is installed on the roof of the associated vehicle with arming member 110 in its inserted position so as to disarm circuit 90 as well as circuit 92. Once the sign has been installed on the roof in its desired position relative to the roof by the use of suction cups 42, 44, and 46 and straps 48, coupling 78 is connected to coupling 82 and plug assembly 84 is inserted into the cigarette lighter of the vehicle. Power is now provided to the sign via cord 80. This power operates to illuminate light assemblies 60, 62, and 64 and further operates to move switch 75*f* of relay 75 to an open condition in which a discontinuity is established in the circuit 90 between relay terminals 75*c* and 75*d*. It will be noted at this time that there are two discontinuities in circuit 90 established respectively by relay 75 and arming device 98 and one discontinuity in circuit 92 established by arming device 98.

It will further be understood that signs of this general type are often used in a delivery mode where the operator of the vehicle moves between a plurality of delivery locations to deliver an item, such as a pizza, to each delivery location. At such time as the operator leaves the vehicle at a delivery location, he simply removes arming member 110 from the sign and places the member in his pocket or in any other secure location so that the arming member remains on his person as he leaves the vehicle. If, in his absence, someone attempts to remove the sign from the roof of the vehicle in an unauthorized manner, either circuit 92 and/or circuit 90 will be activated to activate alarm device 96 to startle the thief and alert others in the vicinity to the theft that is taking place.

Specifically, if the thief, after removing the straps, attempts to lift the sign from the roof of the vehicle, the predetermined prescribed angle of the sign relative to the roof of the vehicle will be changed to an extent to close mercury switch 116 and complete alarm circuit 92 to actuate alarm 96. Further, if for some reason the alarm circuit 92 is defeated by carefully maintaining the predetermined, prescribed angle of the sign relative to the roof, the thief must eventually, in order to consumate the theft, either remove cord 80 from the cigarette lighter of the vehicle or disconnect cord 80 from cord 76 at the connection 78,82. In either case, coil 75*e* of relay 75 is no longer energized so that switch 75*f* of relay 75 moves to a position closing the circuit between relay contact 75*c*,75*d* to complete alarm circuit 90 and again actuate alarm device 96.

Figure 7:
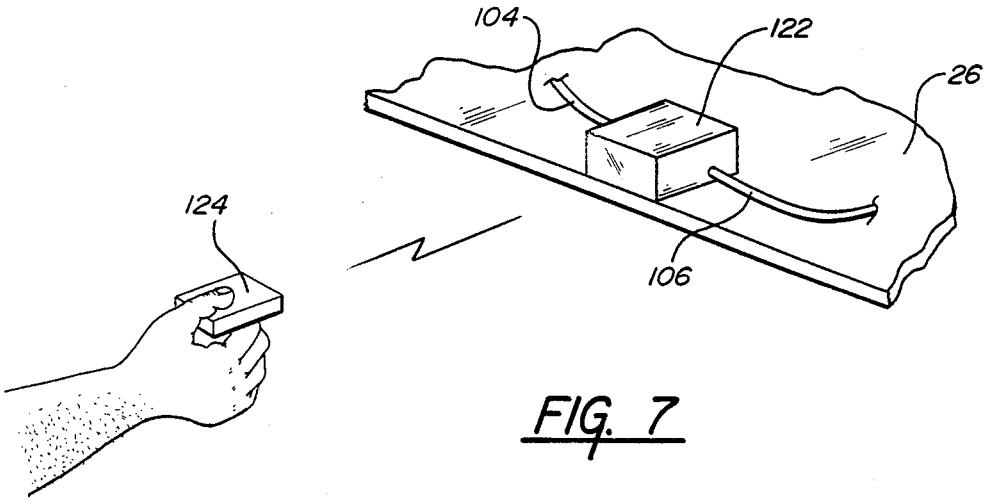
FIG. 7 is a fragmentary perspective view of an alternate form of arming switch.

An alternate arming device is seen in FIG. 7. The arming device of FIG. 7 includes a suitable receiver device 122 suitably secured to bottom wall 26 adjacent the outer edge thereof and a transmitter device 124 adapted to be carried by the operator of the vehicle and to be actuated to transmit a signal to receiver device 122 to open and close a switch included within receiver device 122 so as to selectively arm and disarm circuits 90 and 92 in the manner previously described with respect to the FIGS. 1–6 embodiment. Receiver device 122 and transmitter device 124 may, for example, comprise a remote central receiver and transmitter system available from KSP America Corporation of San Francisco, Calif. as Model A-3000.

It will be seen that the invention sign provides a simple and inexpensive sign which is particularly suited for vehicle rooftop use and which provides maximum visual impact by providing a continuous uninterrupted closed loop viewing display surface extending 360° with respect to the central vertical axis of the sign. It will further be seen that the invention sign provides a simple and effective alarm device to discourage theft of the sign from the associated vehicle. Note that the invention alarm device, once activated, will continue to emit its shrieking alarm for the life of the battery 94 or until alarm circuit 90 is somehow disrupted. However, since the alarm circuit is contained totally within the sign and since the sign is rigidly secured together by the use of fasteners 40, alarm circuit 90 can only be disrupted by disassembling the sign in a time-consuming and painstaking manner, an operation totally inconsistent with a theft type activity.

Whereas preferred embodiments to the invention has been illustrated and described in detail, it will be apparent that various changes may be made in the disclosed embodiments without departing from the scope or spirit of the invention.

I claim:

1. A portable sign for removable mounting on the roof of a vehicle, said sign comprising:

(A) an upper substantially planar frame structure having a triangular configuration;

(B) a lower substantially planar frame structure having a triangular configuration matching that of said upper frame structure;

(C) a side panel assembly of hollow triangular configuration matching the triangular configuration of said upper and lower frame structures, (1) said side panel assembly defining first, second and third plastic panel sides with at least two of said sides formed integrally from a continuous rigid plastic panel bent to form a rigid apex of the assembly triangle and provide a rigid triangular panel structure, (2) said panel assembly extending vertically between said upper and lower frame structures and forming a structural member supporting said upper frame structure with respect to said lower frame structure;

(D) means securing the upper and lower triangular edge portions of said side panel assembly respectively to the laterally outer triangular perimeters of said upper and lower frame structures with the outer display face of each panel side lying substantially in the plane of the associated laterally outer side edges of the frame structures to form a continuous uninterrupted closed loop viewing display surface extending 360 degrees with respect to the central vertical axis of the sign, extending for substantially the full height of said panel sides, and presenting at the outer lateral triangular extents of said sign; and (E) attachment means for removably securing said sign to the roof of the vehicle.

2. A portable sign according to claim 1 wherein:

(F) said upper frame structure includes a downturned triangular flange structure extending totally around the laterally outer triangular perimeter of the frame structure;

(G) said lower frame structure includes an upturned flange structure extending totally around the laterally outer triangular perimeter of the frame structure;

(H) the upper and lower edge portions of said side panel assembly are sized to fit respectively and snuggly within the downturned flanges of the upper frame structure and the upturned flanges of the lower frame structure; and (I) said securing means comprise fastener elements passing through the downturned flange structure of the upper frame structure for engagement with the upper edge portion of the side panel assembly and passing through the upturned flange structure of the lower frame structure for engagement with the lower edge portion of the panel assembly.

3. A portable sign according to claim 1 wherein:

(F) said panel sides are formed of a rigid non-opaque material; and (G) said sign further includes illuminating means positioned within said sign for illuminating indicia on the outer display surfaces of said panel sides.

4. A portable sign for removable mounting on the roof of a vehicle, said sign comprising:

(A) a generally planar rigid upper frame structure of triangular configuration including a downturned flange extending in triangular fashion totally around the laterally outer triangular perimeter of said upper frame structure;

(B) a generally planar rigid lower frame structure having a triangular configuration matching that of said upper frame structure and including an upturned flange extending in triangular fashion totally around the laterally outer triangular perimeter of said lower frame structure;

(C) a rigid hollow side panel assembly having a triangular configuration matching that of said upper and lower frame structures and including three rigid panel sides, (1) at least two of said panel sides formed integrally from a continuous rigid translucent panel bent to form a rigid apex of said side panel assembly and provide a rigid triangular panel structure, (2) said side panel assembly extending rigidly and vertically between said upper and lower frame structures with the upper edge portions of said panel sides seated snuggly within said downturned flange of said upper frame structure and the lower edge portions of said panel sides seated snuggly within the upturned flange of said lower frame structure, (3) said side panel assembly constituting a rigid structural member supporting said upper frame structure with respect to said lower frame structure with the external surfaces of said panel sides totally exposed to form a continuous closed loop external viewing display surface extending 360 degrees with respect to the central vertical axis of the sign, extending uninterrupted from the lower edge of said downturned flange to the upper edge of said upturned flange, and totally exposing the vertical apexes between said panel sides;

(D) affixing means operative to rigidly affix said side panel assembly, said top structure, and said bottom structure together in a manner to leave said external viewing display surface totally visually unobstructed; and (E) attachment means for removably securing said sign to the roof of the vehicle.

5. A portable sign for a vehicle having a roof, said sign comprising:

(A) a body having first, second and third sidewalls, at least two of which are formed of a continuous strip, the first, second and third sidewalls being formed into a rigid triangular body structure having vertically extending apexes;

(B) a top structure including a triangular planar top wall section and a frame section including a downturned flange extending in triangular fashion around the laterally outer triangular perimeter of said top wall section, said downturned flange having an internal circumferential size and shape generally corresponding to the external circumferential size and shape of said triangular body structure;

(C) a bottom structure including a triangular planar bottom wall section and a frame section including an upturned flange extending in triangular fashion around the laterally outer triangular perimeter of said bottom wall section, said upturned flange having an internal circumferential size and shape generally corresponding to the external circumferential size and shape of said triangular body structure;

(D) the upper edge portion of said triangular body structure being positioned within said downturned flange of said top structure and connected to said top structure and the lower edge portion of said triangular body structure being positioned within said upturned flange of said bottom structure and connected to said bottom structure so that said rigid body structure forms a structural interconnection between said top structure and said bottom structure to thereby form a substantially triangular tubular body structure with the vertically extending apexes of said triangular body structure totally exposed and with the external surfaces of said sidewalls coacting to form a continuous closed loop external viewing display surface extending 360 degrees with respect to the central vertical axis of the sign; and (E) attachment means for removably mounting said sign on the roof of the vehicle.

6. A portable sign for a vehicle having a roof, said sign comprising:

(A) a body having first, second and third sidewalls, at least two of which are formed of a continuous strip, the first, second and third sidewalls being formed into a rigid triangular body structure having vertically extending apexes:

(B) a top structure including a triangular planar top wall section and a frame section including a downturned flange extending in triangular fashion around the laterally outer triangular perimeter of said top wall section, said downturned flange having an internal circumferential size and shape generally corresponding to the external circumferential size and shape of said triangular body structure;

(C) a bottom structure including a triangular planar bottom wall section and a frame section including an upturned flange extending in triangular fashion around the laterally outer triangular perimeter of said bottom wall section, said upturned flange having an internal circumferential size and shape generally corresponding to the external circumferential size and shape of said triangular body structure;

(D) the upper edge portion of said triangular body structure being positioned within said downturned flange of said top structure and the lower edge portion of said triangular body structure being positioned within said upturned flange of said body structure to form a substantially triangular tubular body structure with the vertically extending apexes of said triangular body structure totally exposed and with the external surfaces of said sidewalls coacting to form a continuous closed loop external viewing display surface bounded at its top by the lower edge of said downturned flange of said top structure, bounded at its bottom by the upper edge of said upturned flange of said bottom structure, and extending 360 degrees with respect to the central vertical axis of the sign;

(E) affixing means operative to rigidly affix said body structure, said top structure, and said bottom structure together in a manner to leave said external viewing display surface totally visually unobstructed; and (F) attachment means for removably mounting said sign on the roof of the vehicle.

* * * * *